US008388476B2

(12) United States Patent
Ou

(10) Patent No.: US 8,388,476 B2
(45) Date of Patent: Mar. 5, 2013

(54) SPORTS BALL

(76) Inventor: Tsung Ming Ou, Kaohsiung (TW)

( * ) Notice: Subject to any disclaimer, the term of this patent is extended or adjusted under 35 U.S.C. 154(b) by 418 days.

(21) Appl. No.: 12/317,083

(22) Filed: Dec. 18, 2008

(65) Prior Publication Data

US 2009/0107617 A1 Apr. 30, 2009

Related U.S. Application Data

(63) Continuation-in-part of application No. 11/637,378, filed on Dec. 11, 2006, now Pat. No. 7,837,581.

(51) Int. Cl.
*A63B 41/10* (2006.01)

(52) U.S. Cl. ..... 473/605; 473/599; 156/147

(58) Field of Classification Search ..... 473/603–605, 473/597, 599, 607; 156/146, 147, 156, 219, 156/220

See application file for complete search history.

(56) References Cited

U.S. PATENT DOCUMENTS

| | | | | | |
|---|---|---|---|---|---|
| 2,149,465 | A * | 3/1939 | Riddell | ..... | 156/147 |
| 2,214,179 | A * | 9/1940 | Reach | ..... | 156/147 |
| 2,280,314 | A * | 4/1942 | Scudder | ..... | 156/213 |
| 2,653,818 | A * | 9/1953 | Tebbetts, Jr. et al. | ..... | 473/604 |
| 5,888,157 | A * | 3/1999 | Guenther et al. | ..... | 473/604 |
| 6,302,815 | B1 * | 10/2001 | Shishido et al. | ..... | 473/604 |
| 6,413,177 | B1 * | 7/2002 | Guenther et al. | ..... | 473/605 |
| 6,422,961 | B1 * | 7/2002 | Feeney | ..... | 473/604 |
| 6,503,162 | B1 * | 1/2003 | Shishido et al. | ..... | 473/605 |
| 6,645,100 | B2 * | 11/2003 | Guenther et al. | ..... | 473/605 |
| 6,663,520 | B2 * | 12/2003 | Ou Chen | ..... | 473/604 |
| 6,793,597 | B2 * | 9/2004 | Awan | ..... | 473/605 |
| 7,066,853 | B2 * | 6/2006 | Chang | ..... | 156/172 |
| 2004/0087396 | A1 * | 5/2004 | Chan | ..... | 473/605 |
| 2006/0046880 | A1 * | 3/2006 | Tang et al. | ..... | 473/604 |
| 2006/0142101 | A1 * | 6/2006 | Chen | ..... | 473/604 |

* cited by examiner

*Primary Examiner* — Steven Wong
(74) *Attorney, Agent, or Firm* — Raymond Y. Chan; David and Raymond Patent Firm

(57) ABSTRACT

A sports ball includes an inflatable bladder, and a ball carcass. The ball pocket is constructed to have a true roundness shape, having an interior cavity receiving the inflatable bladder therein, wherein when the inflatable bladder is inflated, the ball pocket retains a true roundness shape of the inflatable bladder. The ball carcass includes a ball cushion and a plurality of carcass panels. Each of the carcass panels has a peripheral edge and a flat bottom surface defined within the peripheral edge, wherein the bottom surface of each of the carcass panels is entirely affixed to the ball cushion at a position that the peripheral edge of each of the carcass panels is fittingly aligned with the peripheral edges of the adjacent carcass panels to form a roundness carcass of the sportsball in a stitch-less manner.

15 Claims, 16 Drawing Sheets

SPORTS BALL

CROSS REFERENCE OF RELATED APPLICATION

This is a Continuation-In-Part of a non-provisional application having an application Ser. No. 11/637,378 and a filing date of Dec. 11, 2006 now U.S. Pat. No. 7,837,581.

BACKGROUND OF THE PRESENT INVENTION

1. Field of Invention

The present invention relates to a ball, and more particularly to a sports ball comprising a plurality of carcass panels attached on a ball cushion to form a roundness carcass of the sports ball in a stitch-less manner.

2. Description of Related Arts

A conventional sports ball, such as a conventional soccer ball, usually comprises a ball bladder, an inner lining, and a ball casing. The ball casing comprises a plurality of casing panels attached on the ball bladder, wherein each of the casing panels is usually stitched to adjacent casing panels for forming a substantially round sports ball. Traditionally, much has been done in the development of the ball bladder and intermediate construction between the ball bladder and the ball casing. For example, U.S. patent number of U.S. Pat. No. 6,663,520 to Li Chin Ou Chen discloses a ball pocket bladder for a stitching ball. It aims to enhance the immediate construction between the ball bladder and the outer carcass with a view to enhance the overall structural integrity of the entire stitching ball.

However, there are also several other disadvantages for the stitching structure of soccer balls. For example, the casing panels, being stitched onto the ball bladder, involve expensive and time-consuming manufacturing procedures, yet the resulting sports ball may not have the optimal roundness. One particularly-pressing problem for conventional stitched sports ball is that the casing panels cannot have too sharp a shape for it is difficult for sharp concerns to be adequately stitched with adjacent casing panels.

As a result, sports balls having a stitch-less structure have been developed to overcome the many conventional deep-seated problems present in stitched sports ball. For example, U.S. patent number of U.S. Pat. No. 6,685,585 to Hiroshima et al. discloses a ball for a ball game comprising an elastic bladder, a reinforced layer, and a plurality of leather panels. More specifically, each of the leather panels is bonded onto the reinforced layer, wherein a peripheral edge portion of each leather panels is folded toward an inside. A thickness adjusting member is disposed in a void defined by the folded peripheral portions and bonded onto a back of each leather panel. Although this sports ball does not involve stitching on the leather panels, thereby substantially overcoming the disadvantages associated with stitching, it has several other disadvantages.

First, the Hiroshima's patent specifically discloses a bonding technique thereby each of the leather panels is inwardly folded at the corresponding peripheral portion to bond with the thickness adjusting member. Thus, the Hiroshima's patent discloses a state of art where each the leather panels has two portions, a main portion which is above the thickness adjusting member, and a peripheral portion which is bonded at side portions of the corresponding thickness adjusting member. Now, the problem with this construction is that while the main portion of each of the leather panels is elastically supported by the thickness adjusting member, the corresponding peripheral potion does not. As a result, the sports ball suffers from non-uniform cushion effect because of the bonding technique of the leather panels. When a user of that invention kicks on the main portion of the leather panel, he will enjoy substantial cushioning effect from the thickness adjusting member. However, when the user kicks on the peripheral portion of the leather panel, he will cease to enjoy the same amount of cushioning effect as if he kicks on the main portion.

Second, it is reasonably clear that in order to manufacture the ball stated in the Hiroshima's patent, one must take substantial amount of time for precise and effective attachment between the thickness adjusting member and the leather panels. In other words, the ball disclosed in the Hiroshima's patent requires expensive manufacturing cost. Moreover, since the manufacturing procedures are time-consuming, when the balls are needed in large quantity, such as when the inventors or their assignees or the licensors need to meet substantial market demand, there is little chance that they could produce the balls in large quantity in a relatively short period of time. This is extremely important because major soccer events, such as World Cup, are only held once in a few years.

SUMMARY OF THE PRESENT INVENTION

A main object of the present invention is to provide a sports ball comprising a plurality of carcass panels attached on a ball cushion to form a roundness carcass of the sports ball in a stitch-less manner.

Another object of the present invention is to provide a sports ball comprising a plurality of carcass panels each of which has a slanted edge portion, wherein a thickness of the edge portion of each of the carcass panels is gradually reducing towards a peripheral edge thereof. In other words, the present invention does not utilize folding of the carcass panels for attaching on the inflatable bladder, thereby substantially overcoming the above-mentioned shortcomings of the conventional sports ball.

Another object of the present invention is to provide a sports ball comprising a ball cushion which provides a uniform cushioning effect to the entire sports ball for enhancing a performance thereof. A remarkable feature of the present invention is that the carcass panels can be cut into a wide variety of shapes without affecting the cushioning effect of the sports ball, or the attachment effectiveness between the ball carcass and the ball cushion.

Another object of the present invention is to provide a method of manufacturing the above-mentioned sports ball, wherein the manufacturing method is simple, cost-effective, and efficient. In other words, the present invention provides an optimal method of producing a large quantity of sports ball in a relatively short period of time.

Accordingly, in order to accomplish the above objects, the present invention provides a sportsball, comprising:

an inflatable bladder having a valve stem extended therefrom;

a ball pocket, which is constructed to have a true roundness shape, having an interior cavity receiving the inflatable bladder therein, wherein when the inflatable bladder is inflated, the ball pocket retains a true roundness shape of the inflatable bladder; and a ball carcass, which comprises:

a ball cushion, which is constructed to have a true roundness shape, receiving the ball pocket therein; and a plurality of carcass panels, each of the carcass panels having a peripheral edge and a flat bottom surface defined within the peripheral edge, wherein the bottom surface of each of the carcass panels is entirely affixed to the ball cushion at a position that the peripheral edge of each of the carcass panels is fittingly aligned with the peripheral edges of the adjacent carcass panels to form a roundness carcass of the sportsball in a stitch-less manner, wherein each of the carcass panels has a slanted edge portion extended towards the peripheral edge thereof, wherein a thickness of the edge portion of each of the carcass panels is gradually reducing towards the peripheral edge, wherein the slated edge portion of the carcass panels is formed by pressing the carcass panels in a predetermined mold.

Moreover, the present invention provides a method of manufacturing a sportsball, comprising the steps of:

(a) forming a ball pocket, which is constructed to have a true roundness, having an interior cavity;

(b) disposing an inflatable bladder, having a valve stem, in the ball pocket, wherein when the inflatable bladder is inflated, the ball pocket retains a true roundness shape of the inflatable bladder;

(c) forming a ball cushion, which is constructed to have a true roundness, to receive the ball pocket therein; and (d) affixing a plurality of carcass panels on the ball cushion to form a roundness carcass of the sportsball in a stitch-less manner, wherein each of the carcass panels having a peripheral edge and a flat bottom surface defined within the peripheral edge, wherein the bottom surface of each of the carcass panels is entirely affixed to the ball cushion at a position that the peripheral edge of each of the carcass panels is fittingly aligned with the peripheral edges of the adjacent carcass panels to form the roundness carcass of the sportsball, wherein the step (d) further comprises a pre-step of forming each of the carcass panels in a predetermined mold to form a slanted edge portion extended towards the edge thereof, wherein a thickness of the edge portion of each of the carcass panels is gradually reducing towards the peripheral edge.

These and other objectives, features, and advantages of the present invention will become apparent from the following detailed description, the accompanying drawings, and the appended claims.

DETAILED DESCRIPTION OF THE PREFERRED EMBODIMENT

Figure 1:
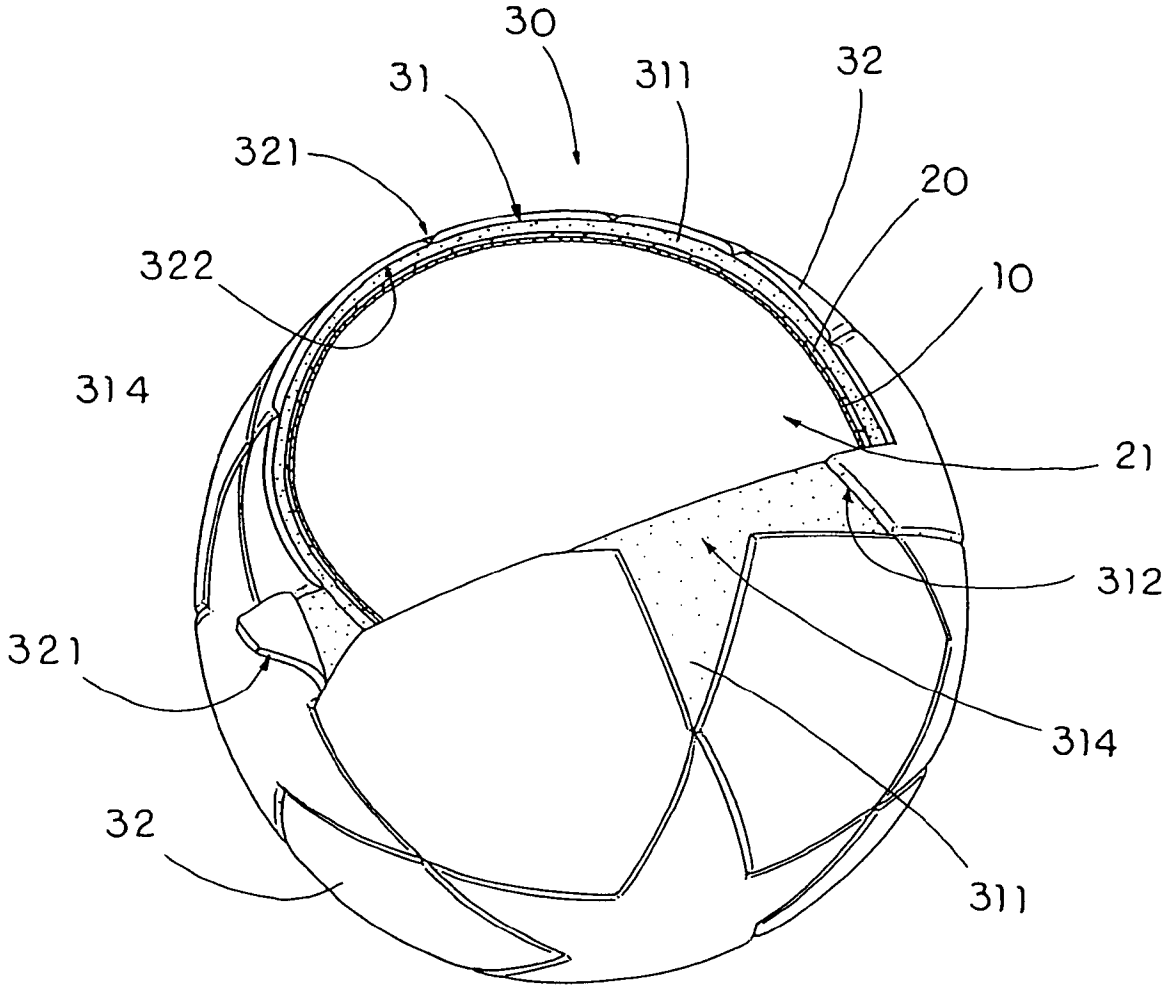
FIG. 1 is a perspective view of a sports ball according to a preferred embodiment of the present invention.
Figure 2:
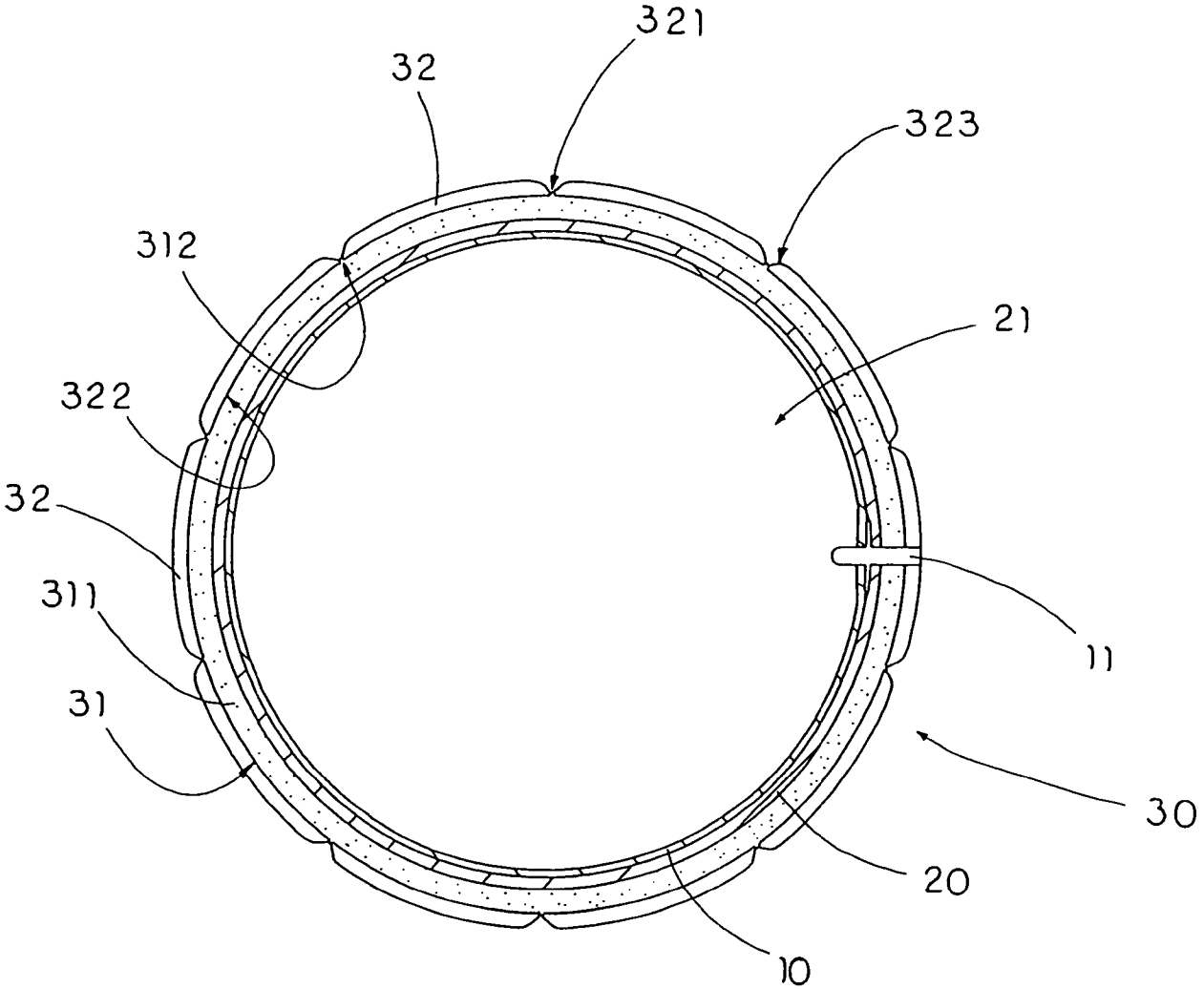
FIG. 2 is a side view of the sports ball according to the above preferred embodiment of the present invention.

Referring to FIGS. 1 to 2 of the drawings, a sports ball, such as a soccer ball, according to a preferred embodiment of the present invention are illustrated, wherein the sports ball comprises an inflatable bladder 10 having a valve stem 11 extended therefrom, a ball pocket 20, and a ball carcass 30.

The ball pocket 20, which is constructed to have a true roundness shape, having an interior cavity 21 receiving the inflatable bladder 10 therein to form a ball body, in which when the inflatable bladder 10 is inflated, the ball pocket 20 retains a true roundness shape of the inflatable bladder 10.

The ball carcass 30 comprises a ball cushion 31 and a plurality of carcass panels 32. The ball cushion 31, which is constructed to have a true roundness shape, is arranged to receive the ball pocket 20 within the ball cushion 31.

Each of the carcass panels 32 has a peripheral edge 321 and a flat bottom surface 322 defined within the peripheral edge 321, wherein the bottom surface 322 of each of the carcass panels 32 is entirely affixed to the ball cushion 31 at a position that the peripheral edge 321 of each of the carcass panels 32 is fittingly aligned with the peripheral edges 321 of the adjacent carcass panels 32 to form a roundness carcass of the sports ball in a stitch-less manner.

According to the preferred embodiment of the present invention, the inflatable bladder 10 is made of flexible plastic materials, such as rubber, wherein the inflatable bladder 10 is adapted to be fully inflated through the valve stem 11 to form a substantially spherical shape.

Moreover, the ball pocket 20 comprises a plurality of pocket panels 22 which are overlappedly laminated with each other side by side and are treated to form an integral spherical structure of the ball pocket 20 so as to retain a true roundness shape of the inflatable bladder 10 after the inflatable bladder 10 has been inflated. Thus, the pocket panels 22 are securely attached onto the inflatable bladder 10 for embedding the inflatable bladder 10 within the ball pocket 20 in the interior cavity 21. As such, the inflatable bladder 10 is substantially enhanced in strength and thereby protected from excessive external impact.

It is worth mentioning that the pocket panels 22 of the ball pocket 20 are preferably made of thin fabric materials having a desirable materials strength so that when the pocket panels 22 are overlappedly attached on the inflatable bladder 10, the ball pocket 20 thereby formed is capable of protecting the inflatable bladder. In addition, latex is preferably applied on the ball pocket 20 for durability strength and rebound enhancement purpose.

In order to further enhance the strength of the ball pocket 20, the ball pocket may further comprise an adhesive layer formed between the pocket panels 22 and an outer surface of the inflatable bladder 10 for ensuring effective protection of the inflatable bladder 10 by the ball pocket 20. It is important to point out that the adhesive layer is optionally in that when the inflatable bladder 10 has been fully inflated, the ball pocket 20 is nevertheless expanded to form a spherical supporting structure for protecting the inflatable bladder 10.

On the other hand, ball cushion 31 of the ball carcass 30 comprises at least a cushion layer 311 which is overlapped on the ball pocket 20 and is treated to form an integral spherical structure of the ball cushion 31, so as to provide a cushion effect for the sports ball at any point thereof. According to the preferred embodiment of the present invention, the cushion layer 311 is made of expandable forming material which is thin when untreated, and when the cushion layer 311 is heat-treated, and preferably vulcanized, the cushion layer 311 is expanded to form a foaming cushion layer of the ball cushion 31. The cushion layer 311 will then provide a uniform cushion effect to the sports ball for ensuring uniform performance thereof when the sports ball is actually in use in a ball game. More specifically, the cushion layer 311 is made of rubber arranged when the cushion layer 311 is heat-treated, the cushion layer 311 forms a spherical foaming cushion around the ball pocket 20. Thus, the inflatable bladder 10 is substantially protected by the ball pocket 20 as well as the cushion layer 311.

The ball cushion 31 further has a plurality of panel guiders 312 which are integrally formed on an outer spherical surface 313 thereof and are shaped corresponding to contours of the carcass panels 32 to guide the carcass panels 32 affixing on the outer spherical surface 313 of the ball cushion 31. According to the preferred embodiment of the present invention, the panel guiders 312 are formed when the cushion layer 311 is treated in a predetermined mold for forming the spherical foaming cushion, wherein the panel guiders 312 are protruded from and extended along the outer spherical surface 313 of the ball cushion 31. The panel guiders 312, being extended along the outer spherical surface 313 of the ball cushion 31, form a corresponding number of panel cavities 314 between at least two panel guiders 312, wherein the contour of the corresponding carcass panels 32 corresponds with the shape of the corresponding panel cavity 314. As such, each of the carcass panels 32 is adapted to be securely attached onto the corresponding panel cavity 314 for form the outermost layer of the sports ball of the present invention. It is worth mentioning that the carcass panels 32 are preferably made of materials which can be chemically dyed or patterned for forming an artistic appearance of the sports ball. For example, the carcass panels 32 can be made of leather or rubber.

Referring to FIG. 2 of the drawings, each of the carcass panels 32 further has a slanted edge portion 323 extended towards the peripheral edge 321 thereof, wherein a thickness of the slanted edge portion 323 of each of the carcass panels 32 is gradually reducing toward the peripheral edge 321 of the corresponding carcass panel 32. This feature of the sports ball has three advantages: first, the carcass panels 32 are uniformly attached on the ball cushion 31 to provide the uniform cushioning effect over the entire sports ball; second, since the attachment of the carcass panels 32 does not involve any stitching procedure, the carcass panels 32 can be shaped and crafted to have any cross sectional shape without needing to concern if the cross sectional shape is compatible for stitching; third, the aesthetic appearance of the sports ball can be preserved. In fact, according the preferred embodiment of the present invention, at least one of the carcass panels 32 is cut to have a sharp corner having an acute angle to adhere on the ball cushion 31 for forming a desirable aesthetic appearance of the sports ball of the present invention.

Moreover, in order to further enhance the secure attachment between the carcass panels 32 and the ball cushion 31, the peripheral edges 321 of the carcass panels 30 are interlocked with each other to cover on the ball cushion 31 in a hidden manner, in such a manner that the carcass panels 32 are adhered on the ball cushion 31 to form the roundness ball carcass 30 in a stitch-less manner.

It is worth mentioning that as a slight alternative of the preferred embodiment, the ball cushion 31 can comprise a plurality of cushion layers 311 overlappedly affixed to the bottom surfaces 322 of the carcass panels 32 respectively, wherein the cushion layers 311 are overlapped on the ball pocket 20 to form an integral spherical structure of the ball cushion 31, so as to provide a cushion effect for the sports ball at any point thereof. It is appreciated that the carcass panels 32 can be directly attached to the ball pocket 20 without the cushion layers 311 to form the sports ball. In other words, the ball cushion 31 can be eliminated the carcass panels 32 are formed as the cushioned carcass and directly adhered on the ball pocket 20.

It is particularly important at this stage to mention that the forgoing description of the sports ball of the present invention is not limited to the particular example of the preferred embodiment, i.e. a soccer ball. Instead, the sports ball of the present invention may be specifically designed and crafted, with all the above structural limitations and features, to form other kinds of sports ball, such as a basketball or even a volley ball. With all the features and limitation of the present invention, the difference between a soccer ball and a say, basketball, may be mere the aesthetic appearance of the carcass panels 32.

Figure 3A:
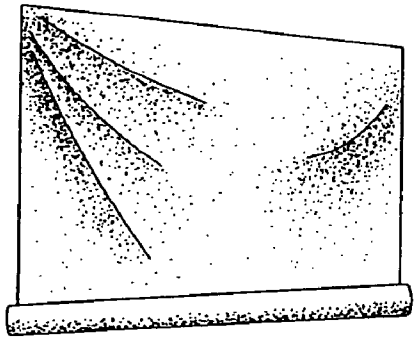
FIGS. 3A to 3V are schematic diagrams of a method of manufacturing a sports ball according to the above preferred embodiment of the present invention.
Figure 3B:
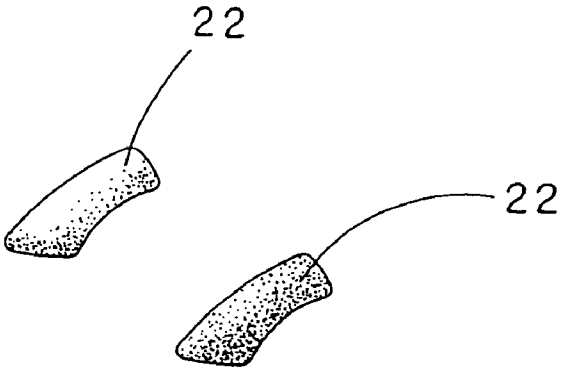
Figure 3C:
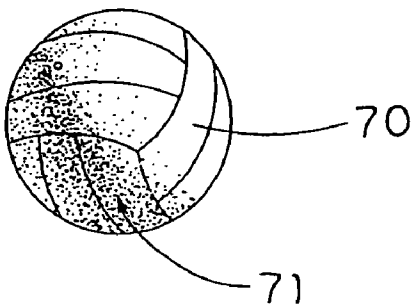
Figure 3D:
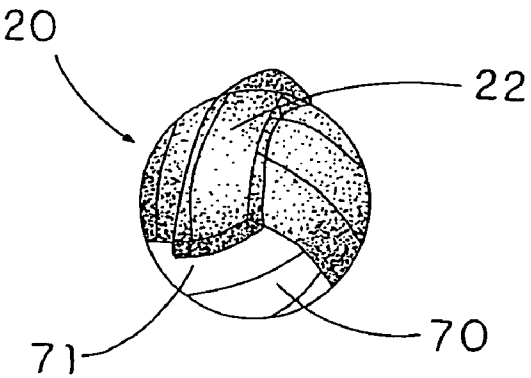
Figure 3F:
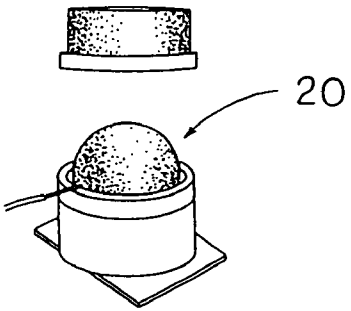
Figure 3H:
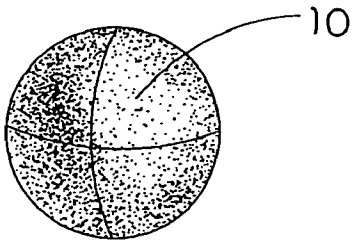
Figure 3E:
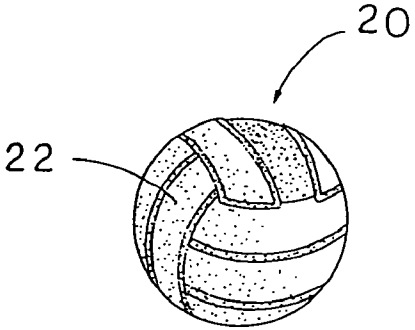
Figure 3G:
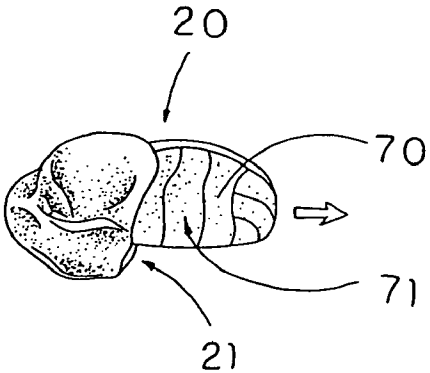
Figure 3I:
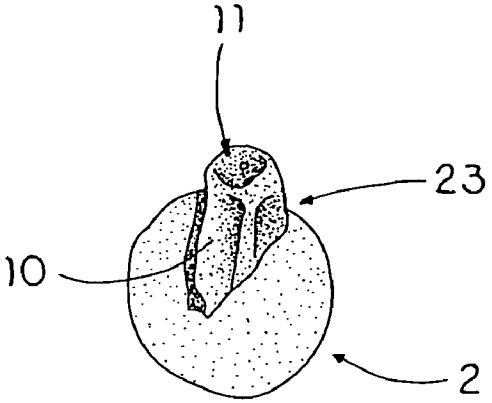
Figure 3J:
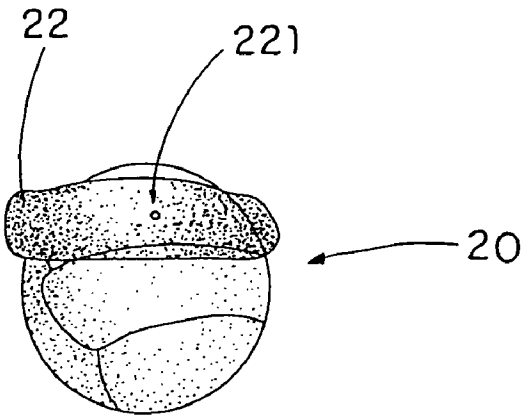
Figure 3K:
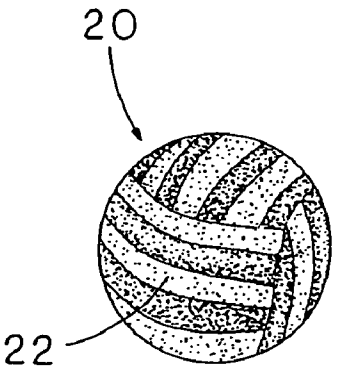
Figure 3L:
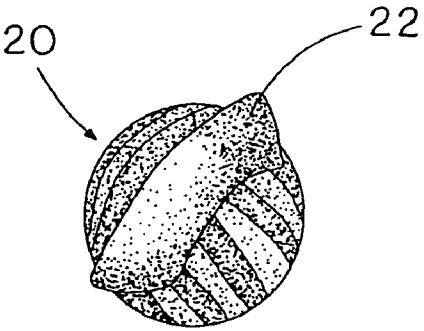
Figure 3N:
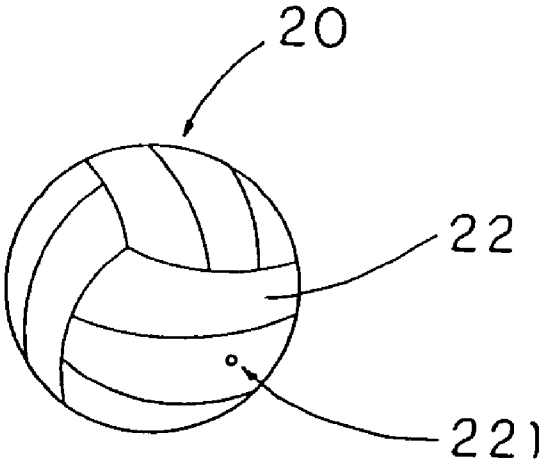
Figure 3M:
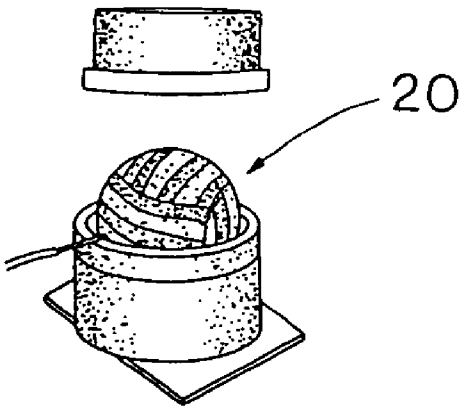
Figure 3P:
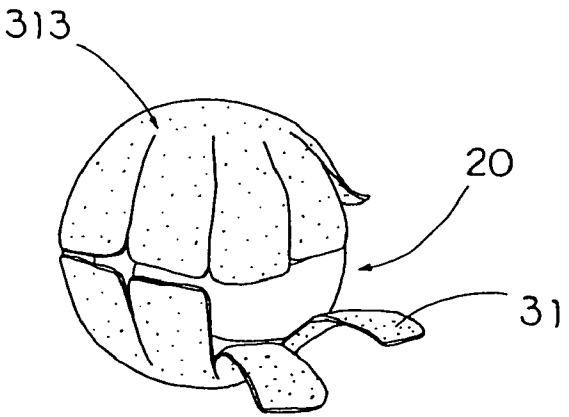
Figure 3R:
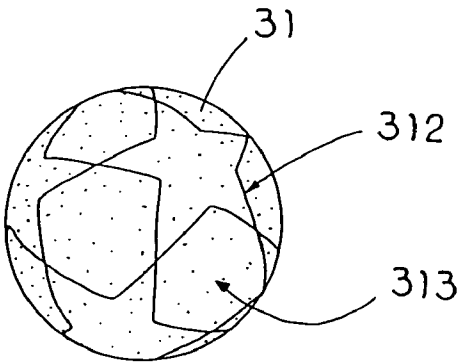
Figure 3O:
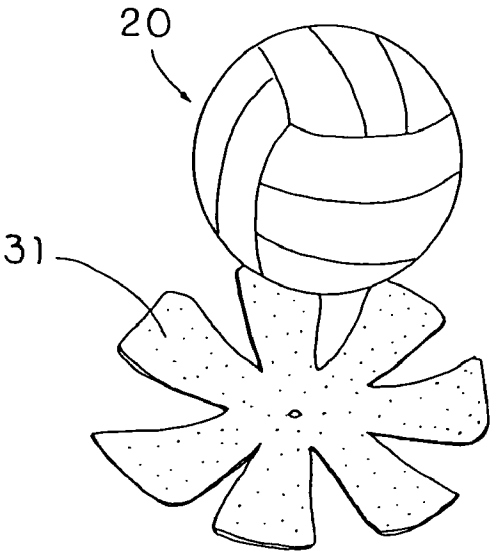
Figure 3Q:
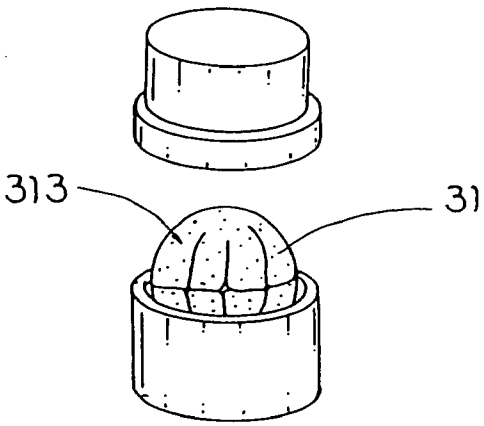
Figure 3T:
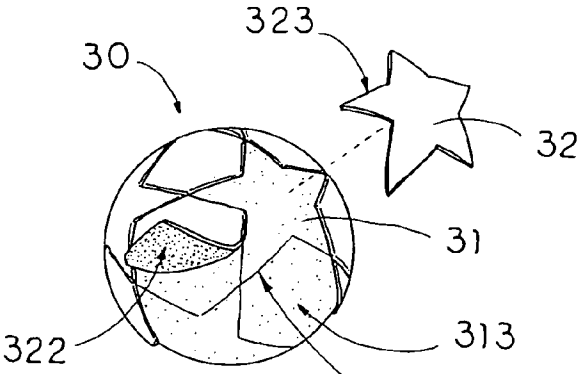
Figure 3V:
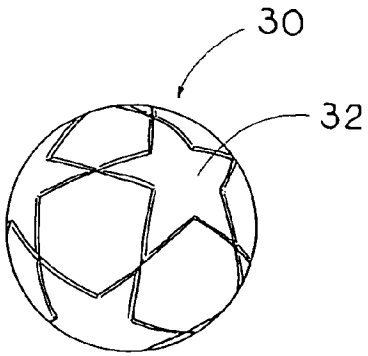
Figure 3S:
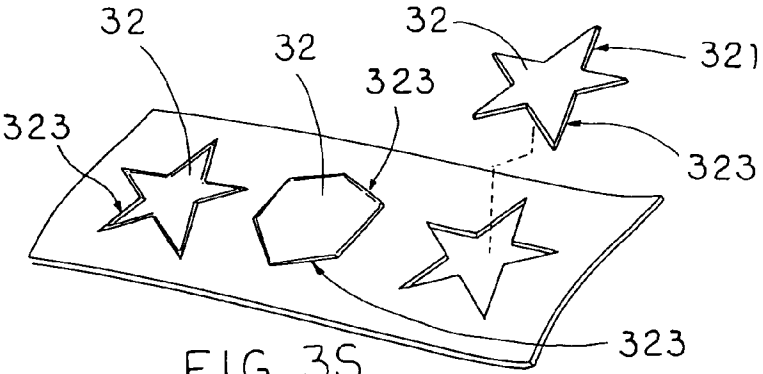
Figure 3U:
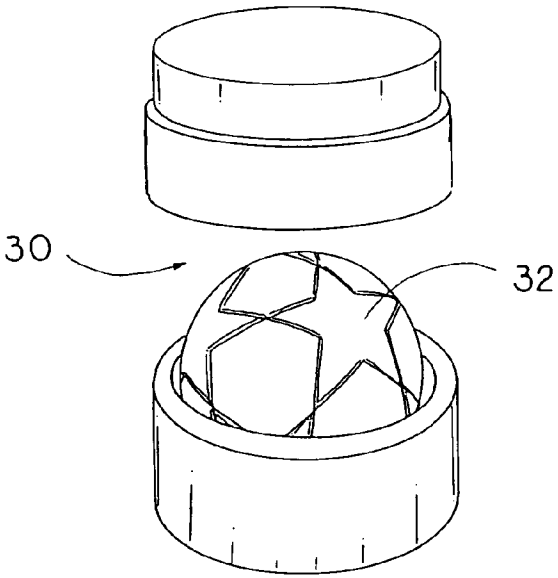

Referring to FIG. 3A to FIG. 3V of the drawings, a method of manufacturing a sports ball according to the preferred embodiment of the present invention is illustrated, in which the method comprises the steps of:

(a) forming a ball pocket 20, which is constructed to have a true roundness, having an interior cavity 21;

(b) disposing an inflatable bladder 10, having a valve stem 11, in the ball pocket 20, wherein when the inflatable bladder 10 is inflated, the ball pocket 20 retains a true roundness shape of the inflatable bladder 10;

(c) forming a ball cushion 31, which is constructed to have a true roundness, to receive the ball pocket 20 therein; and (d) affixing a plurality of carcass panels 32 on the ball cushion 31 to form a roundness ball carcass 30 of the sports ball in a stitch-less manner, wherein each of the carcass panels 32 having a peripheral edge 321 and a flat bottom surface 322 defined within the peripheral edge 321, wherein the bottom surface 322 of each of the carcass panels 32 is entirely affixed to the ball cushion 31 at a position that the peripheral edge 321 of each of the carcass panels 32 is fittingly aligned with the peripheral edges 321 of the adjacent carcass panels 32 to form the roundness ball carcass 30 of the sports ball.

According to the preferred embodiment of the present invention, the step (c) is optional since the ball cushion 31 can be provided at the carcass panel 32. Or, the ball cushion 31 can be omitted. For enhancing the cushioning effect of the sports ball, the step (c) comprises the steps of:

(c.1) overlapping at least a cushion layer 311 on the ball pocket 20; and (c.2) vulcanizing the cushion layer 311 to form an integral spherical foaming cushion around the ball pocket 20 to provide a cushion effect for the sports ball at any point thereof. Note that the heat treatment (vulcanization) can be performed by conventional heating machine, such as a vulcanizing machine.

Moreover, step (c.2) further comprises a step of integrally forming a plurality of panel guiders 312 on an outer spherical surface 313 thereof, wherein the panel guiders 312 are shaped corresponding to contours of the carcass panels 32 to guide the carcass panels 32 affixing on the outer spherical surface 313 of the ball cushion 31.

Step (a) further comprises the steps of:

(a.1) providing a parent bladder 70 having a true roundness shape after the parent bladder 70 is inflated;

(a.2) overlapping a plurality of pocket panels 22 on the parent bladder 70 at a position that edge portions of the pocket panels 22 are overlapped with edge portions of the adjacent pocket panels 22, wherein one of the pocket panels 22, having a valve hole 221, is remained unattached to form a first inlet opening 23 of the ball pocket 20;

(a.3) heat-treating the pocket panels 22 to integrally bond the ball panels 22 together to form a hollow round ball body having a first inlet opening 23 provided thereon;

(a.4) removing the parent bladder 70 from the hollow round ball body through the inlet opening 23 after the parent bladder 70 is deflated;

(a.5) disposing the inflatable bladder 10 in the hollow round ball body through the inlet opening 23 before the inflatable bladder 10 is inflated; and (a.6) sealing the first inlet opening 23 with attaching the unattached pocket panel 22 at a position that the valve hole 221 is aligned with the valve stem 11 to sealedly enclose the interior cavity 21 to form a primary ball pocket 20.

In order to ensure easy removal of the parent bladder 70 and effective attachment of the pocket panels 22, step (a.2) further comprises the step of applying a removing agent on a spherical surface 71 of the parent bladder 70 and applying an adhering element on the pocket panels 22.

Alternatively, the pocket panels 22 can be attached or adhered on the inflatable bladder 10 without performing the heat-treating process. The heat-treating process can be performed in the step (c) to bond the cushion layer 311 and the pocket panels 22 with the inflatable bladder 10 at the same time.

In order to form a slanted edge portion 323 for each of the carcass panels 32, step (d) further comprises a pre-step of pre-cutting each of the carcass panels 32 to form a slanted edge portion 323 extended towards the edge thereof, wherein a thickness of the slanted edge portion 323 of each of the carcass panels 32 is gradually reducing towards the peripheral edge 321.

It is worth mentioning that the carcass panels 32 are cut by a specifically prepared die-cut apparatus, in which each of the carcass panels 32 is first cut half-way for forming the corresponding slanted edge portion 323 and then cut thoroughly to form a carcass panel 32 having the slanted edge portion 323. In other words, the carcass panels 32 can be effectively and swiftly cut to attach on the ball cushion 31.

Moreover, step (d) further comprises a step of interlocking the peripheral edges 321 of the carcass panels 32 with each other to cover on the ball cushion 20 in a hidden manner. Thus, the attachment strength of the carcass panels 32 can be substantially enhanced.

Corresponding with the slight alternative as mentioned above, step (d) may further comprises the steps of overlappedly affixing a plurality of cushion layers 311 to the bottom surfaces 322 of the carcass panels 32 respectively, and overlapping the cushion layers 311 on the ball pocket 20 to form an integral spherical structure of the ball cushion 31 so as to provide a cushion effect for the sports ball at any point thereof.

It should be appreciated from the above disclosure that the sports ball of the present invention can be manufactured efficiently and in a cost-effective manner so as to overcome the above-mentioned shortcomings for conventional sports ball.

According to the preferred embodiment of the present invention, step (a) further comprises the steps of:

(a.7) overlapping a plurality of pocket panels 22 onto the primary ball pocket 20 at a position that edge portions of the pocket panels 22 are overlapped with edge portions of the adjacent pocket panels 22, wherein one of the pocket panels 22, having a valve hole 221, is remained unattached to form a second inlet opening 23 of the ball pocket 20;

(a.8) heat-treating the additional pocket panels 22 to integrally bond the ball panels 22 together to form a hollow round ball body having second inlet opening 23 provided thereon;

(a.9) sealing the second inlet opening 23 with attaching the unattached pocket panel 22 at a position that the valve hole 221 is aligned with the valve stem 11 to sealedly enclose the interior cavity 21 to form a preferred ball pocket 20.

Note that step (a.7) to step (a.9) are optionally required depending on the circumstances of manufacture. Where stronger ball pocket 20 is required, step (a.7) to step (a.9) effective provide an enhance structure of the ball pocket 20. However, it is important to point out that step (a.1) to step (a.6) suffice to produce a complete ball pocket 20 with a predetermined strength.

It is worth mentioning that the step (c) is optional, wherein the cushion layer 311 can be directly provided at the bottom surface 322 of the carcass panels 32.

Figure 4A:
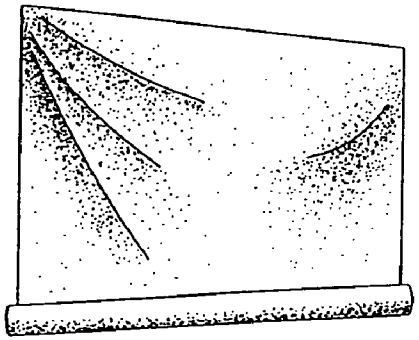
FIGS. 4A to 4V are schematic diagrams of an alternative mode of the method of manufacturing the sports ball according to the above preferred embodiment of the present invention.
Figure 4B:
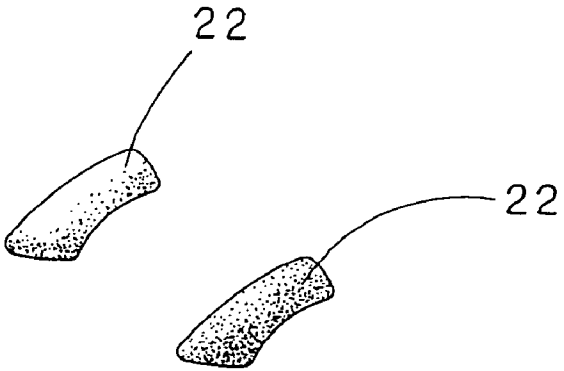
Figure 4C:
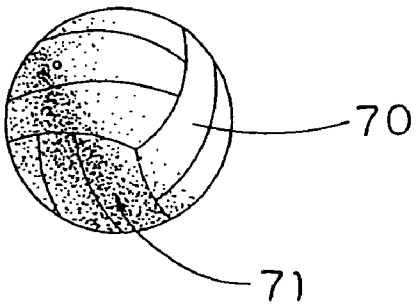
Figure 4D:
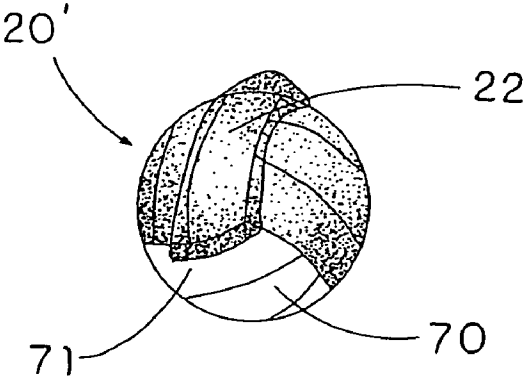
Figure 4F:
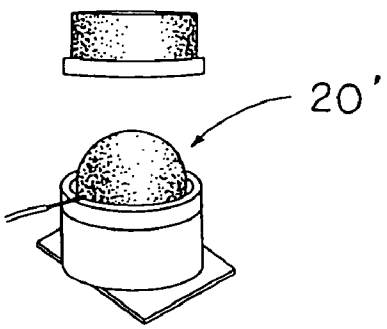
Figure 4H:
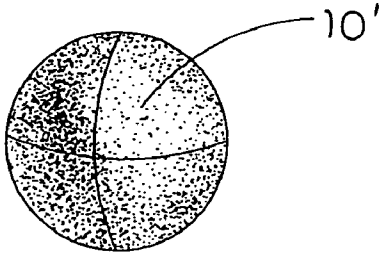
Figure 4E:
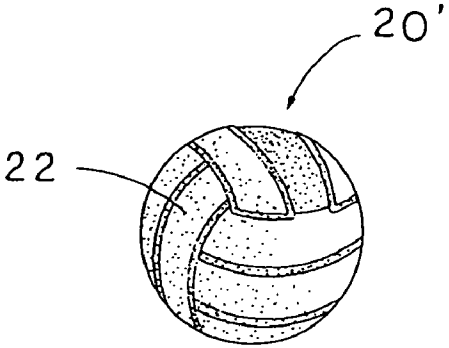
Figure 4G:
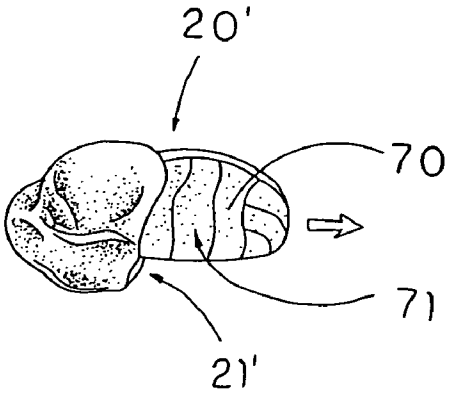
Figure 4J:
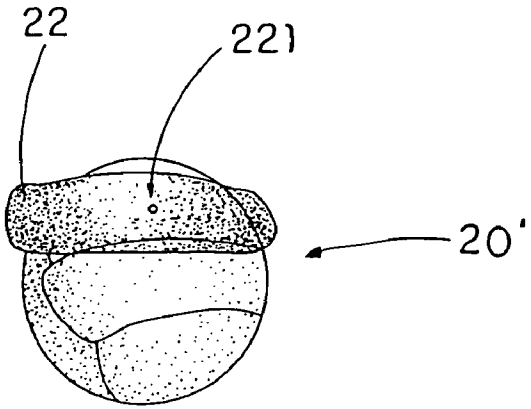
Figure 4L:
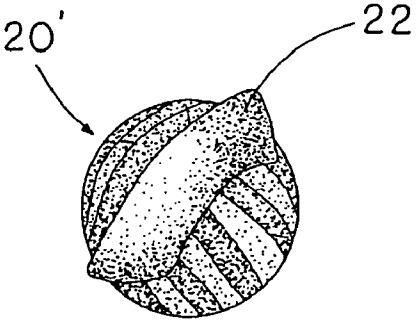
Figure 4I:
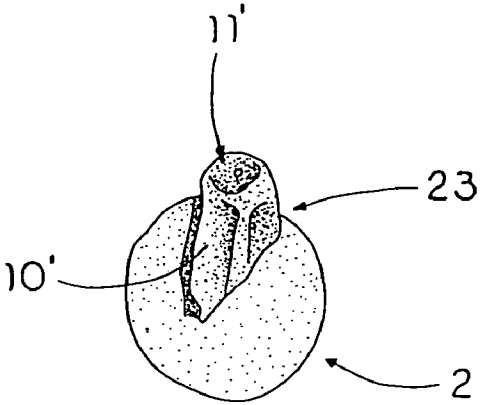
Figure 4K:
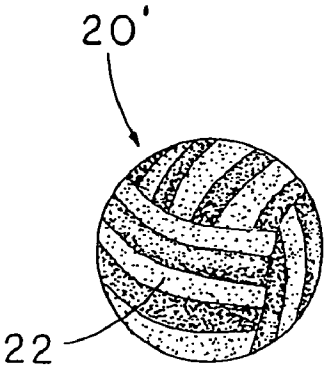
Figure 4N:
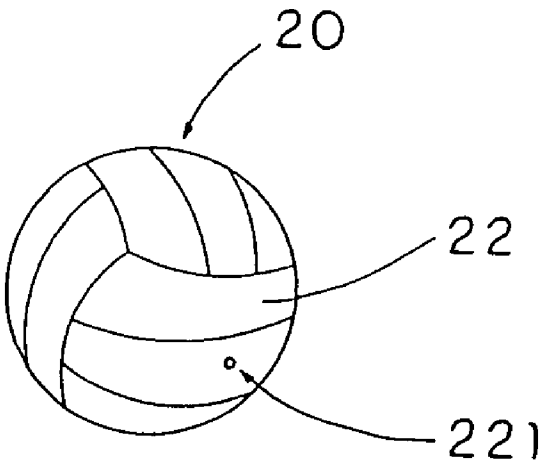
Figure 4M:
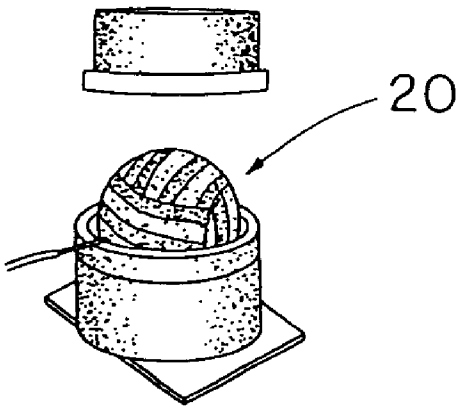
Figure 4P:
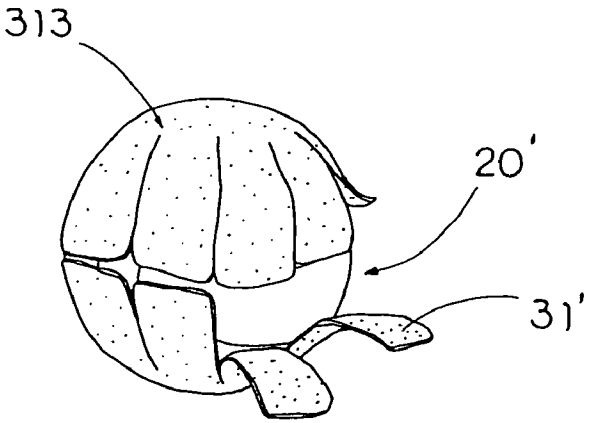
Figure 4R:
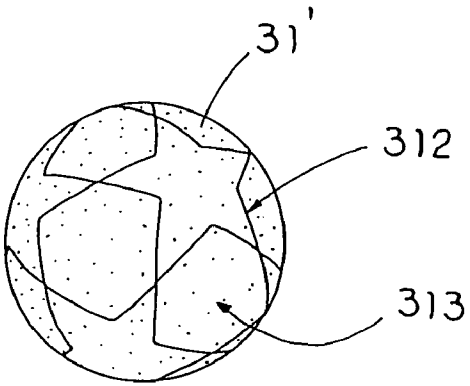
Figure 4O:
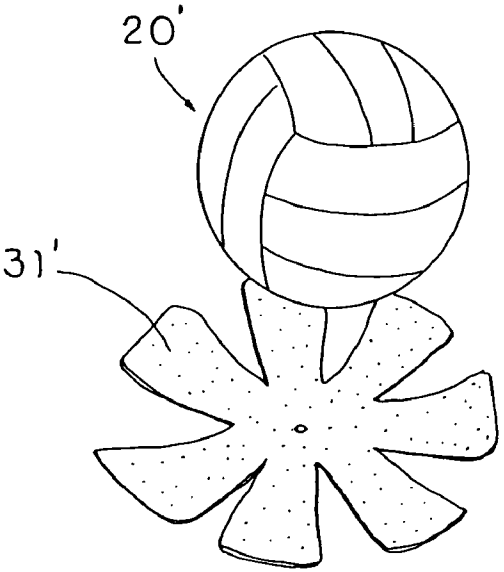
Figure 4Q:
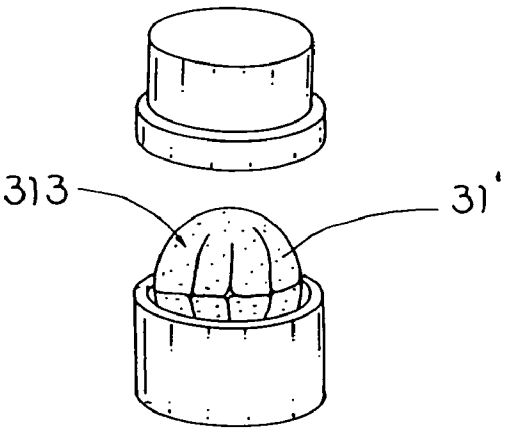
Figure 4T:
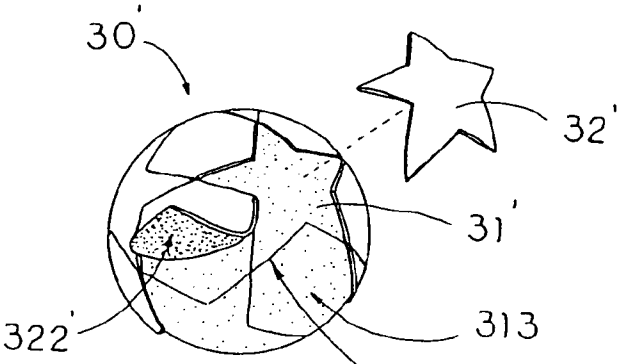
Figure 4V:
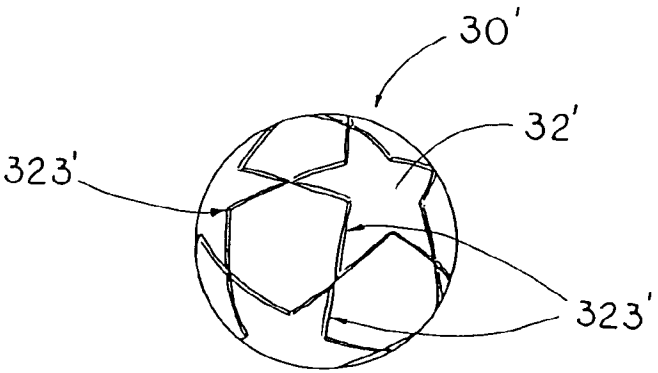
Figure 4S:
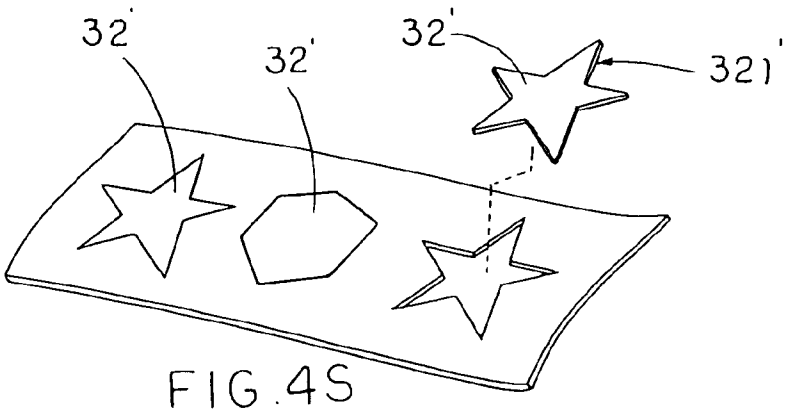

Referring to FIG. 4A to FIG. 4V of the drawings, a first alternative mode of the manufacturing method of the sports ball according to the preferred embodiment of the present invention is illustrated. According to the alternative mode, the method of manufacturing the sports ball, comprises the steps of:

(a') forming a ball pocket 20', which is constructed to have a true roundness, having an interior cavity 21';

(b') disposing an inflatable bladder 10', having a valve stem 11', in the ball pocket 20', wherein when the inflatable bladder 10' is inflated, the ball pocket 20' retains a true roundness shape of the inflatable bladder 10';

(c') forming a ball cushion 31', which is constructed to have a true roundness, to receive the ball pocket 20' therein; and (d') affixing a plurality of carcass panels 32' on the ball cushion 31' to form a roundness carcass 30' of the sportsball in a stitch-less manner, wherein each of the carcass panels 32' having a peripheral edge 321' and a flat bottom surface 322' defined within the peripheral edge 321', wherein the bottom surface 322' of each of the carcass panels 32' is entirely affixed to the ball cushion 31' at a position that the peripheral edge 321' of each of the carcass panels 32' is fittingly aligned with the peripheral edges 321' of the adjacent carcass panels 32' to form the roundness ball carcass 30' of the sportsball.

Moreover, the step (d') further comprises a pre-step of forming each of the carcass panels 32' in a predetermined mold 80' to form a slanted edge portion 323' extended towards the edge thereof via the channel makers 81' protruded from inner surface of the predetermined mold 80'. A thickness of the slanted edge portion 323' of each of the carcass panels 32' is gradually reducing towards the peripheral edge 321', wherein the slated edge portion 323' of the carcass panels 32' is formed by pressing the carcass panels 32' in the predetermined mold 80'.

Alternatively, the ball carcass 30" comprises a plurality of carcass panels 32", wherein each of the carcass panels 32" is constructed from a plurality of polygon panels integrally bonded with each other edge-to-edge. For example, each of the carcass panels 32" is constructed by five hexagonal polygon panels and three pentagonal polygon panels integrally extended therefrom in an edge-to-edge manner. In other words, there are four identical pieces of the carcass panels 32" which are to be attached on the ball body to form the ball carcass 30" for enclosing the ball body therein, such that each of the carcass panels 32" form a quarter of the ball carcass 30".

In addition, each of the carcass panels 32" is embossed to create a predetermined slope thereon with respect to the corresponding polygon panels so as to stand out the shapes polygon panels protruding on the ball carcass 30" when the carcass panels 32" are attached on the ball body. In other words, the channels of the ball carcass 30" are pre-formed on each of the carcass panels 32".

In order to form a slanted edge portion 323" for each of the carcass panels 32", each of the carcass panels 32" is pre-cut to form the slanted edge portion 323" extended towards the edge thereof, wherein a thickness of the slanted edge portion 323" of each of the carcass panels 32" is gradually reducing towards the peripheral edge thereof. Therefore, when the carcass panels 32" are attached on the ball body edge-to-edge, the slanted edge portions 323" of the carcass panels 32" form the channels of the sports ball.

Figure 4U:
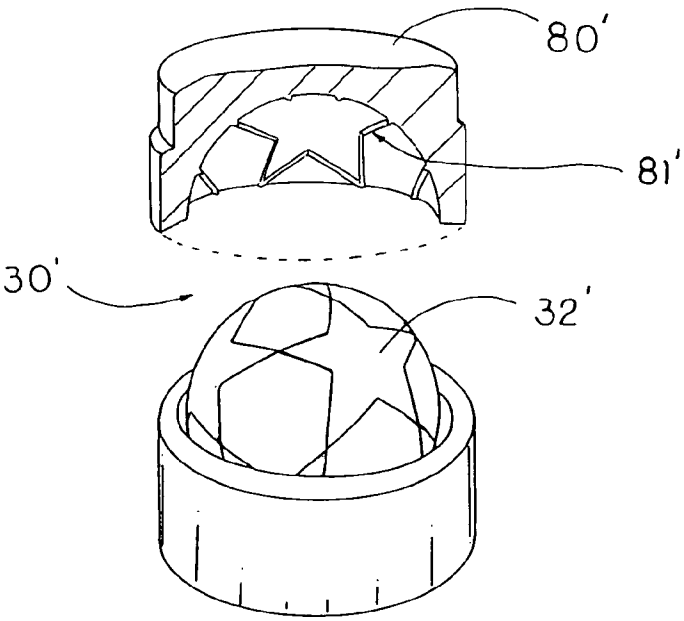
Figure 5S:
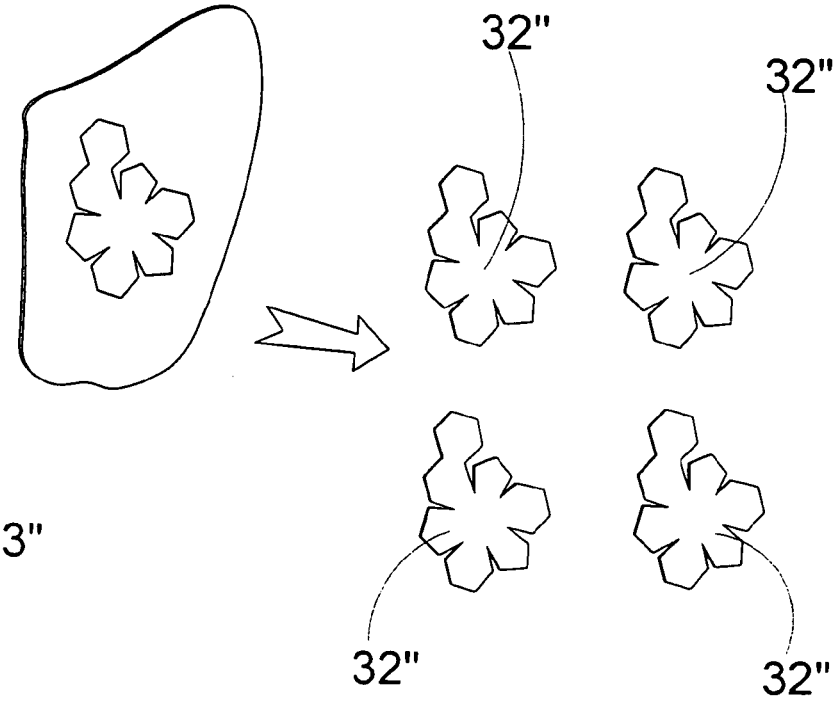
FIGS. 5S to 5V are schematic diagrams illustrating an alternative mode of the ball carcass according to the above preferred embodiment of the present invention.
Figure 5T:
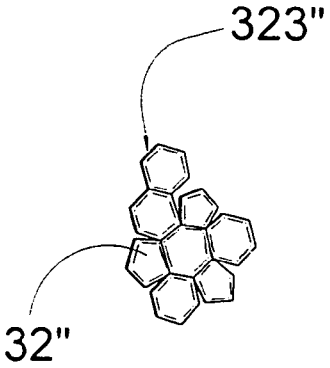
Figure 5V:
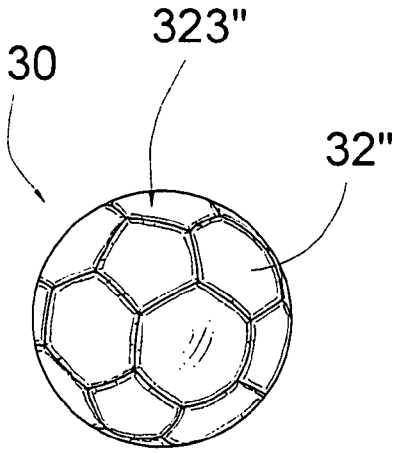
Figure 5U:
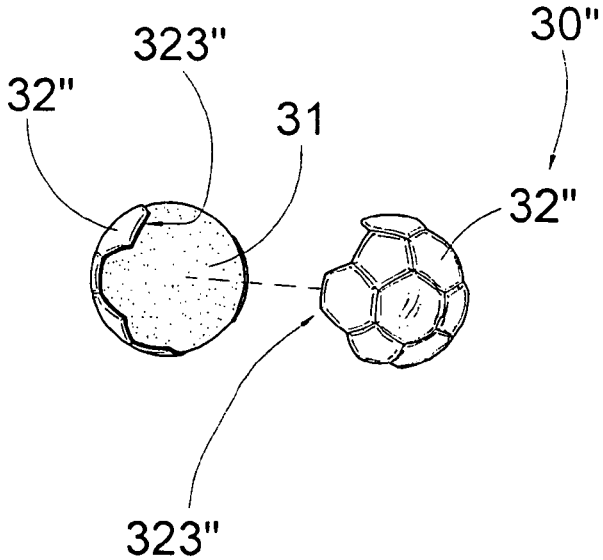

Accordingly, the ball body can be formed from the step 4A to step 4R. In the step 5S, the carcass panels 32" are cut from a carcass sheet. In step 5T, each of the carcass panels 32" is embossed to create a predetermined slope thereon so as to pre-form the channels of the ball carcass 30". In step 5U, the carcass panels 32" are adhered on the ball body to form the sports ball as in FIG. 5V. It is worth mentioning that the slanted edge portion 323" of the carcass panels 32" can be formed in step 5S. Alternatively, the slanted edge portion 323" of the carcass panels 32" can be formed by the predetermined mold 80' via the channel makers 81' as in FIG. 4U.

Figure 6:
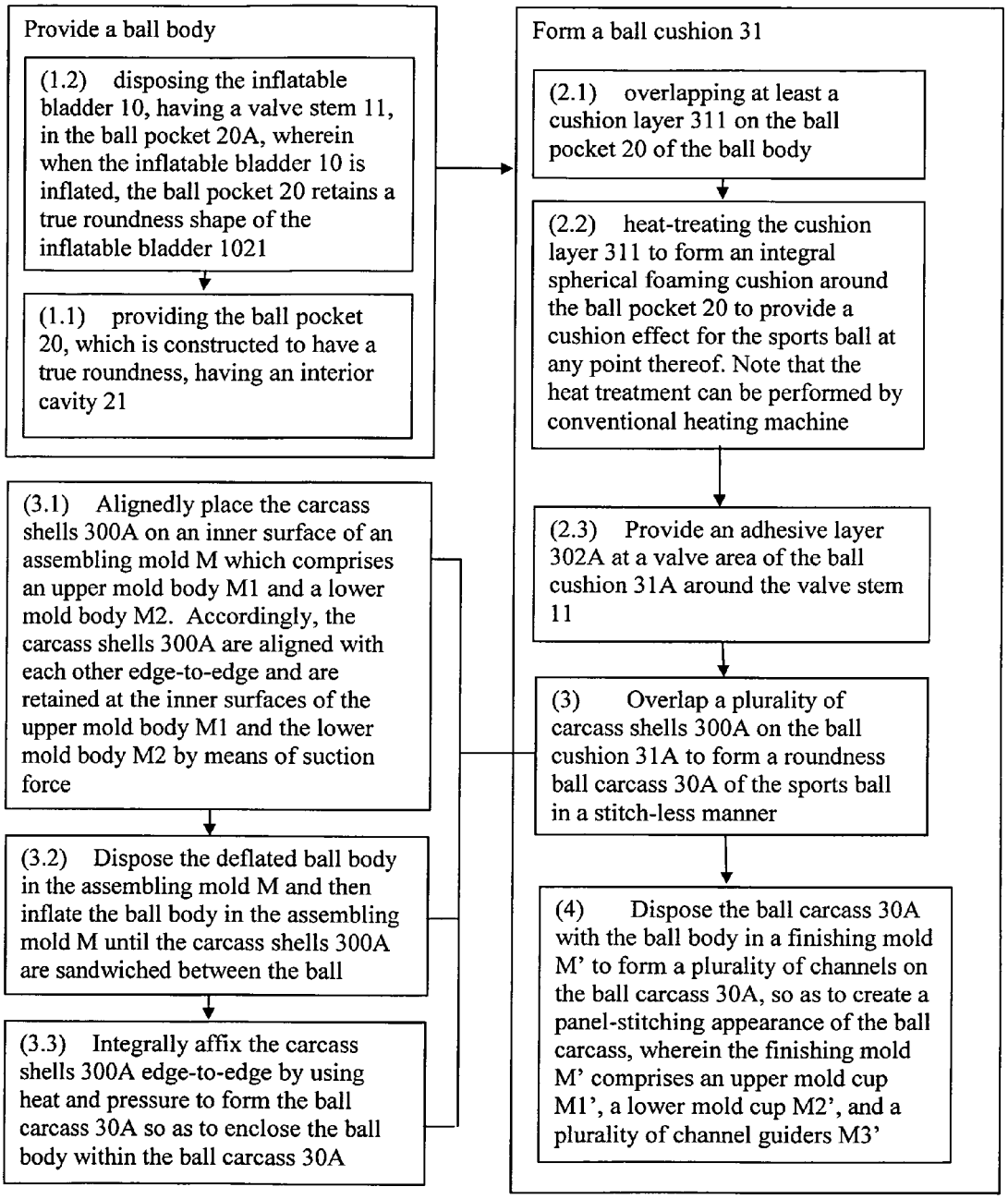
FIG. 6 is a schematic diagram illustrating an alternative mode of the ball carcass of FIGS. 5S to 5V according to the above preferred embodiment of the present invention.

FIG. 5 and FIG. 6 illustrate another alternative mode of the manufacturing method of the sports ball, as a lamination basketball, which comprises the following steps.

(1) Provide a ball body, having a true roundness shape, comprising a ball pocket 20 and an inflatable bladder 10, wherein the ball body is formed by the steps of:

(1.1) providing the ball pocket 20, which is constructed to have a true roundness, having an interior cavity 21; and (1.2) disposing the inflatable bladder 10, having a valve stem 11, in the ball pocket 20A, wherein when the inflatable bladder 10 is inflated, the ball pocket 20 retains a true roundness shape of the inflatable bladder 10.

(2) Form a ball cushion 31, which is constructed to have a true roundness, to receive the ball body therein, wherein the ball cushion 31 is formed by the steps of:

(2.1) overlapping at least a cushion layer 311 on the ball pocket 20 of the ball body; and (2.2) heat-treating the cushion layer 311 to form an integral spherical foaming cushion around the ball pocket 20 to provide a cushion effect for the sports ball at any point thereof. Note that the heat treatment can be performed by conventional heating machine.

(3) Overlap a plurality of carcass shells 300A on the ball cushion 31A to form a roundness ball carcass 30A of the sports ball in a stitch-less manner, wherein the carcass shells 300A are affixed with each other edge-to-edge to enclose the ball cushion 31A inside the ball carcass 30A.

Accordingly, each of the carcass shells 300A contains a plurality of carcass panels 32A integrally joined with each other to form a one piece structure, wherein one of the carcass shell has a valve hole 301A provided thereat to align with the valve stem 11 of the ball body when the ball body is enclosed within the ball carcass 30A.

According to the preferred embodiment, the step (3) further comprises the following steps.

(3.1) Alignedly place the carcass shells 300A on an inner surface of an assembling mold M which comprises an upper mold body M1 and a lower mold body M2. Accordingly, the carcass shells 300A are aligned with each other edge-to-edge and are retained at the inner surfaces of the upper mold body M1 and the lower mold body M2 by means of suction force.

(3.2) Dispose the deflated ball body in the assembling mold M and then inflate the ball body in the assembling mold M until the carcass shells 300A are sandwiched between the ball cushion 31 and the inner surface of the assembling mold M by air pressure. Accordingly, adhesives are optionally applied on the ball cushion 31 to hold the carcass shells 300A on the ball cushion 31 when the ball body is inflated.

(3.3) Integrally affix the carcass shells 300A edge-to-edge by using heat and pressure to form the ball carcass 30A so as to enclose the ball body within the ball carcass 30A.

It is appreciated that the step (2) can be omitted such that there is no ball cushion 31 provided at the ball body. In other words, the ball cushion 31 is optionally provided at the sports ball.

Accordingly, the assembling mold M comprises an air suction arrangement for providing the suction force within the upper and lower mold bodies M1, M2 to hold the carcass shells 300A at the inner surfaces thereof. The air suction arrangement contains a plurality of sucking holes 41A spacedly provided at the inner surfaces of the upper and lower mold bodies M1, M2 and a suction device 42A communicating with the sucking holes 41A to create the suction effect at the sucking holes 41A such that the carcass shells 300A are sucked and disposed on the inner surface of each of the upper and lower mold bodies M1, M2. It is worth to mention that the assembling process of the sports ball is operated by machine via the assembling mold M to speed up the manufacturing process of the sports ball in comparison with the conventional assembling process that the carcass panels 32A must be affixed on the ball body manually. In addition, the assembling mold M further has a plurality of positioning guiders 43A provided at the inner surfaces of the upper and lower mold bodies M1, M2 to guide the positions of the carcass shells 300A on the inner surfaces of the upper and lower mold bodies M1, M2. In other words, the peripheral edge of each of the carcass shells 300A is aligned along the positioning guiders 43A to ensure the alignment of the carcass shells 300A.

Accordingly, the step (2) of the manufacturing process further comprises the following step.

(2.3) Provide an adhesive layer 302A at a valve area of the ball cushion 31A around the valve stem 11 to firmly attach the ball cushion 31A to the ball carcass 30A via the adhesive layer 302A while the rest area of the ball cushion 31A is unattached to the ball carcass 30A.

For the conventional process of manufacturing the lamination sports ball, the ball carcass 30A is adhered to the ball body that the inner surface of the ball carcass 30A must be bonded with the outer surface of the ball body. In other words, the overall thickness of the conventional lamination sports ball is substantially increased by the thickness of the ball carcass 30A and the thickness of the ball body. Unlike the conventional stitching sports ball, the carcass panels of the present invention are stitched edge-to-edge to form the ball carcass for the ball body receiving therein. The outer surface of the ball body is unattached to the inner surface of the ball carcass. The ball body can be inflated to pop the ball carcass and can be deflated to reduce the volume of the ball carcass.

Therefore, the conventional lamination sports ball cannot be deflated. It is inconvenient for the conventional lamination sports ball to be stored and transported as the conventional stitching sports ball. The present invention provides the lamination sports ball having the feature of the stitching sport ball that the outer surface of the ball cushion 31A is unattached to the inner surface of the ball carcass 30A such that the sports ball of the present invention can be deflated as the conventional stitching sports ball does. In other words, the ball body can be inflated to pop the ball carcass 30A and can be deflated to deform the roundness shape of the ball carcass 30A and to reduce the volume of the ball carcass 30A. It is worth to mention that the adhesive layer 302A is provided at the valve area of the ball cushion 31A around the valve stem 11 to retain the alignment of the valve stem 11 of the ball body with the valve hole 301A of the ball carcass 30A, especially when the ball body is deflated.

According to the preferred embodiment, after the ball body is enclosed within the ball carcass 30A, the manufacturing process of the sports ball further comprises the following step.

(4) Dispose the ball carcass 30A with the ball body in a finishing mold M' to form a plurality of channels on the ball carcass 30A, so as to create a panel-stitching appearance of the ball carcass.

Accordingly, each of the carcass shells 300A has a flat outer surface such that after the carcass shells 300A are coupled with each other edge-to-edge, the ball carcass 30A will only has the connection lines formed along the peripheral edge of the carcass shells 300A. In order to form the channels on the ball carcass 30A, the finishing mold M' comprises an upper mold cup M1', a lower mold cup M2', and a plurality of channel guiders M3', as the slanted edge maker, protruded from inner surfaces of the upper and lower mold cups M1', M2', such that when the ball carcass 30A is disposed within the upper and lower mold cups M1', M2', the channel guiders M3' are pressed on the outer surface of the ball carcass 30A to form the channels thereon. Therefore, when the channels are formed on the ball carcass 30A, the carcass panels 32A are formed on the ball carcass 30A.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A method of manufacturing a sports ball, comprising the steps of:

(1) providing a ball body, which has a true roundness shape, having a valve stem formed thereat;

(2) overlapping a plurality of carcass panels on said ball body to form a roundness ball carcass in a stitch-less manner, wherein said carcass panels are integrally bonded with each other edge-to-edge to enclose said ball body inside said ball carcass, wherein one of said carcass panels has a valve hole aligning with said valve stem of said ball body;

(3) forming a ball cushion, which is constructed to have a true roundness, to receive said ball body therein, wherein said ball cushion is formed between said ball body and said ball carcass in such a manner that an outer surface of said ball cushion is unattached to an inner surface of said ball carcass; and (4) forming a plurality of channels on said ball carcass to create a panel-stitching appearance of said ball carcass, wherein each of said carcass panels has a slanted edge portion arranged in such a manner that when said carcass panels are bonded edge-to-edge, said slanted edge portions of said carcass panels form said channels of said ball carcass.

2. The method, as recited in claim 1, wherein said step (2) comprises a step of pre-cutting each of the carcass panels to form said slanted edge portion extended towards an edge thereof, such that said carcass panels with said slanted edge portions are attached to said ball body to form said channels on said ball carcass.

3. The method, as recited in claim 2, wherein said step (3) comprises a step of placing said ball carcass having said ball body therewithin in a predetermined mold to form said slanted edge portions of said ball panels via a plurality of channel makers protruded from an inner surface of said predetermined mold, such that after said carcass panels without said slanted edge portions are attached to said ball body, said channels are formed on said ball carcass in said predetermined mold.

4. The method, as recited in claim 3, wherein each of said carcass panels is cut into a predetermined shape to bond with another said carcass panel in a non-stitching manner.

5. The method, as recited in claim 4, further comprising a step of providing an adhesive layer to said ball cushion at an area around said valve stem of said ball body such that said valve stem of said ball body and said valve hole of said ball carcass are retained into position with respect to each other.

6. The method, as recited in claim 3, wherein each of said carcass panels is constructed from a plurality of polygon panels integrally bonded with each other edge-to-edge.

7. The method, as recited in claim 4, wherein each of said carcass panels is constructed from a plurality of polygon panels integrally bonded with each other edge-to-edge.

8. The method, as recited in claim 5, wherein each of said carcass panels is constructed from a plurality of polygon panels integrally bonded with each other edge-to-edge.

9. The method, as recited in claim 6, wherein each of said carcass panels is embossed to create a predetermined slope thereon with respect to said corresponding polygon panels so as to stand out the shapes of polygon panels protruding on said ball carcass when said carcass panels are attached on said ball body.

10. The method, as recited in claim 7, wherein each of said carcass panels is embossed to create a predetermined slope thereon with respect to said corresponding polygon panels so as to stand out the shapes of polygon panels protruding on said ball carcass when said carcass panels are attached on said ball body.

11. The method, as recited in claim 8, wherein each of said carcass panels is embossed to create a predetermined slope thereon with respect to said corresponding polygon panels so as to stand out the shapes of polygon panels protruding on said ball carcass when said carcass panels are attached on said ball body.

12. The method, as recited in claim 4, wherein said ball cushion comprises at least a cushion layer which is overlapped on said ball body and is treated to form an integral spherical structure of said ball cushion, so as to provide a cushion effect for the sports ball at any point thereof.

13. The method, as recited in claim 5, wherein said ball cushion comprises at least a cushion layer which is overlapped on said ball body and is treated to form an integral spherical structure of said ball cushion, so as to provide a cushion effect for the sports ball at any point thereof.

14. The method, as recited in claim 8, wherein said ball cushion comprises at least a cushion layer provided at a bottom surface of each of said ball panels to provide a cushion effect for the sports ball at any point thereof.

15. The method, as recited in claim 11, wherein said ball cushion comprises at least a cushion layer provided at a bottom surface of each of said ball panels to provide a cushion effect for the sports ball at any point thereof.

* * * * *